US005323627A

United States Patent [19]

Lonati et al.

[11] Patent Number: 5,323,627

[45] Date of Patent: Jun. 28, 1994

[54] MULTIPLE YARN FEED CIRCULAR KNITTING MACHINE, IN PARTICULAR FOR STOCKINGS

[75] Inventors: Fausto Lonati; Ettore Lonati; Tiberio Lonati, all of Brescia, Italy

[73] Assignee: Santoni S.r.l., Brescia, Italy

[21] Appl. No.: 53,217

[22] Filed: Apr. 28, 1993

[30] Foreign Application Priority Data

Apr. 30, 1992 [IT] Italy ..... MI92 A 001044

[51] Int. Cl.[5] ..... D04B 9/10

[52] U.S. Cl. ..... 66/221; 66/222; 66/215

[58] Field of Search ..... 66/218, 219, 220, 221, 66/222, 215, 20, 231, 232

[56] References Cited

U.S. PATENT DOCUMENTS

| | | | |
|---|---|---|---|
| 3,805,555 | 4/1974 | Nuber | 66/222 |
| 3,855,819 | 12/1974 | Sawazaki | 66/221 |
| 3,875,764 | 4/1975 | Wills-Morem et al. | 66/222 |
| 3,940,950 | 3/1976 | Sawazaki | 66/222 |
| 3,955,380 | 5/1976 | Piccimo | 66/222 X |
| 4,718,254 | 1/1988 | Lonati | 66/222 X |
| 4,838,048 | 6/1989 | Müller et al. | 66/222 X |

*Primary Examiner*—Clifford D. Crowder
*Assistant Examiner*—John J. Calvert
*Attorney, Agent, or Firm*—Diller, Ramik & Wight

[57] ABSTRACT

In a multi-feed small-diameter circular knitting machine provided with needles, jacks and selectors, the selector raising cams have a smaller height than the jack cams, so that the selectors return to their selection position while the jacks are still descending. The selectors and jacks therefore move independently after an initial raising by the selectors acting on the jacks. The selectors move within a cylinder trick portion which lies at a greater distance from the cylinder axis than the trick portion within which the needle and jacks move, and comprise an appendix extending towards the cylinder for engaging the jacks. The machine can have a larger number of selection positions than known machines for the same needle circle diameter and fineness.

18 Claims, 2 Drawing Sheets

MULTIPLE YARN FEED CIRCULAR KNITTING MACHINE, IN PARTICULAR FOR STOCKINGS

BACKGROUND OF THE INVENTION

This invention relates to a multiple yarn feed circular knitting machine, in particular for stockings.

SUMMARY OF THE INVENTION

More particularly, the invention relates to a circular knitting machine of small-diameter type for producing multi-colour knitwear articles such as stockings, provided with a needle cylinder with vertical tricks in which the needles, their jacks and underlying selectors slide, the needles, jacks and selectors being controlled by cams generally fixed relative to the rotatable cylinder and acting on butts on the needles, jacks and selectors. The selectors can be selected to activate or inactivate the respective needles at the various yarn feeds by selection devices associated with the feeds.

It is well known that in these machines the small diameter and hence circumference of the needle cylinder means that only a limited number of yarn feeds and correctly selectable individual positions are possible, with the result that the possible patterns are also limited. In other words not only is the obtainable variety of different colour patterns limited, but also the variety of patterns originating from raising the needles into different positions, such as the tuck stitch position etc.

These limitations are substantially due to the fact that the raising and lowering cams for the needles, jacks and/or selectors cannot exceed a certain maximum inclination, namely 45°, and space must be left along the cylinder circumference for selecting the selectors. With a greater inclination the needles, jacks and/or selectors would jam and would not allow working to continue. With a smaller inclination the maximum number of selection positions would be further reduced because the pitch between one selection position and the next would increase substantially for the same cam raising height and cylinder circumference.

It will be apparent that the greater the number of selection positions the greater the variety of patterns or effects which can be achieved on a patterned knitwork product, such as different colour patterns, placed patterns, mesh patterns and the like. An object of the present invention is therefore to increase the selection facility and hence the variety of patterns obtainable in a circular knitting machine, in particular for stockings, for an equal cylinder or needle circle diameter.

In achieving this object a further object is to provide a machine of the specified type which uses substantially conventional stitch formation elements, i.e. normal needles, jacks and selectors obtainable by conventional methods and means and hence not requiring the use of special needle components requiring special and/or high-cost machining.

Again in achieving these objects a further object is to provide a machine able advantageously to use widely known and reliable selection devices. The same applies to the cams, yarn guides and other typical elements of these machines.

In achieving these objects the raising and lowering angles for the selectors and/or the jacks and/or the needles are not to be increased beyond the traditional maximum limits, hence ensuring complete reliability of operation.

These objects are achieved according to the invention by a multiple yarn feed circular knitting machine, particularly for stockings, comprising a needle cylinder with longitudinal tricks in which needles, their jacks and underlying selectors slide, cams for controlling the needles, the jacks and the selectors by engagement with butts thereon, the needle cylinder being driven with movement relative to the cams, and provided with a plurality of selection positions associated with the yarn feeds and in which the selectors such as to activate or inactivate the associated needles, the selectors being of the type which rock about a fulcrum, characterised in that the selectors comprise a shank slidable within a portion of the needle cylinder trick situated at a distance from the cylinder axis which is greater than that of the trick portion in which the jacks and needles slide, the selectors comprising an appendix for engaging the respective jacks which extends radially towards the needle cylinder, the selector rocking fulcrum being located on the radially outer edge of the respective jacks, the selector raising cams being of smaller height than the jack raising cams, and the selectors being lowered by lowering cams independently of the respective jacks in such a manner as to reattain their selection position when the respective jacks descend or are about to substantially reach the lowest point on the jack lowering cams.

Advantageously, in a machine of this type the selector raising and lowering cams are arranged on a circumference of diameter and hence length greater than that of the needle circle, and as they have a smaller height than the jack raising and lowering cams a greater number of selection positions can be provided for the same diameter of that part of the cylinder in which the needles operate, i.e. that part which forms the knitted hose. By virtue of the selector appendix projecting radially inwards of the needle cylinder, the raising of the jacks is achieved with total reliability, i.e. the engagement between the selectors and the jacks occurs in proximity to the base of the cylinder trick, as in normal machines.

The selectors raised to activate the respective needles provide only the initial movement to the jacks, the rest of the upward jack movement being provided by the cams. The selectors hence descend again before the jacks, and it is no longer necessary for the jacks to urge the selectors downwards towards the position in which their selection takes place. Hence the selectors can already be in their selection position when the jacks reach their point of maximum descent. A new selection can therefore be immediately made, for example it is possible to return those needles into operation which have just operated, so increasing the range of patterns obtainable.

Positioning the selector fulcrum on the radially outer edge of the jacks allows the selectors to undergo normal rocking movement for selection purposes, while the jacks are in movement. The selector and jack raising and lowering cams, which in the machine according to the invention operate on butts at a different radial distance from the cylinder axis, i.e. on selector butts that lie at a greater distance from the cylinder axis and on jack butts that lie at a smaller distance from the cylinder axis, can all be maintained within the angle limit of 45° because the cams which operate on the selectors and are located a greater distance from the cylinder axis have a lesser amplitude and length than those which operate on the jacks and are located a smaller distance from the cylinder axis, which are not only of greater height but can also have a greater width because it is no longer the lowering movement of the jacks which lowers the selectors, but instead these latter are made to descend from a lower maximum position by their own cams, independently of the jacks.

The present invention therefore does not penalize the machine in terms of speed and reliability, while enabling more selection points to be provided than was previously possible in a machine of the same number of needles and the same needle circle diameter, i.e. the diameter of that cylinder part which determines the size of the knitted hose. In a machine according to the invention with the traditional diameter of 3½ inches it becomes possible to operate with six selection positions and hence with five colours and one background yarn.

Further details and advantages of the invention will be more apparent from the description of a preferred embodiment of the invention given hereinafter by way of example with reference to the accompanying drawings, in which:

DESCRIPTION OF THE PREFERRED EMBODIMENTS

Figure 1:
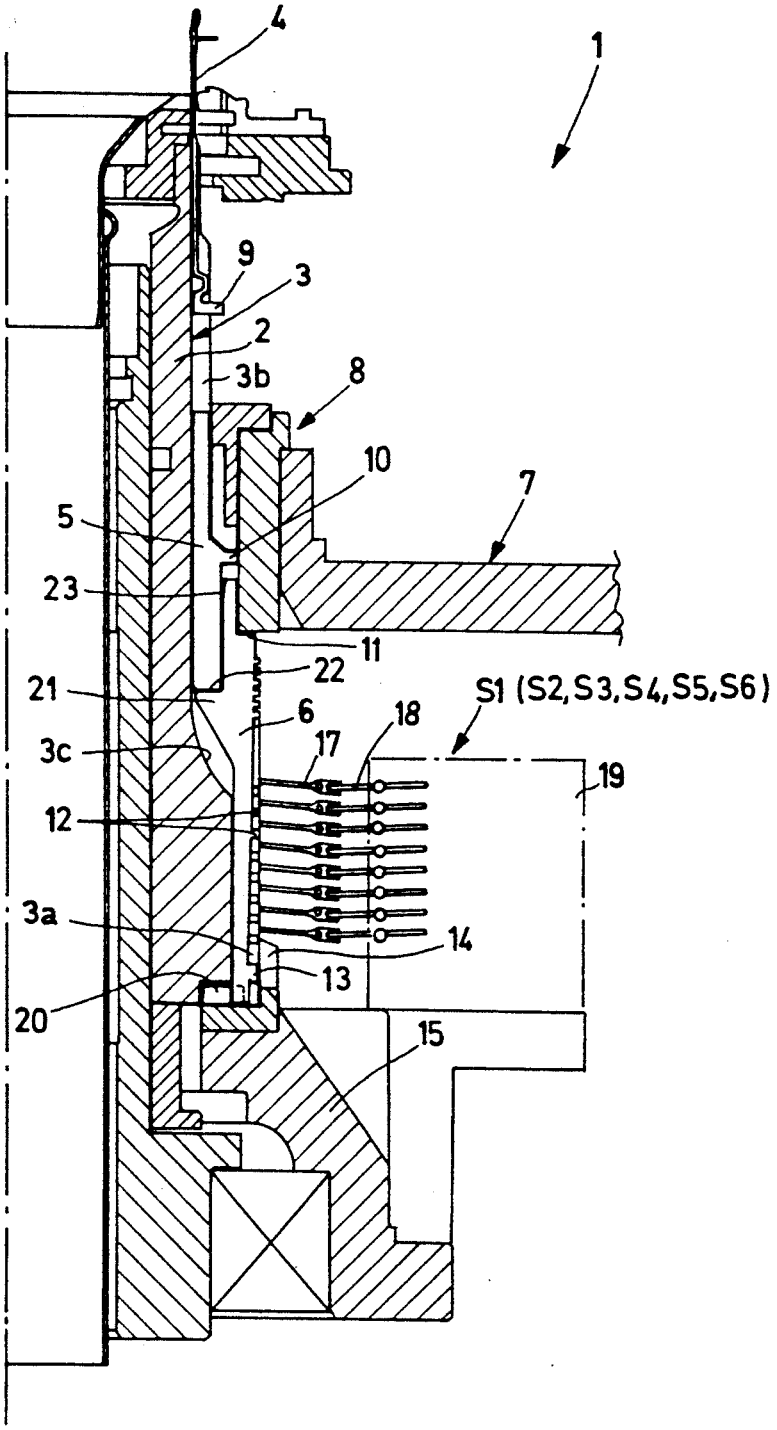
FIG. 1 is a partial axial section through a circular knitting machine according to the invention.

With reference to said figures, a single-cylinder circular knitting machine 1, in particular of the small-diameter type for stocking manufacture, comprises a cylinder 2 provided in known manner with vertical (longitudinal) tricks 3 in which needles 4, jacks 5 and underlying selectors 6 slide. The cylinder 2 is supported rotatably, while a fixed structure indicated overall by 7 surrounds the cylinder 2 and carries the control cams for the needles, jacks and selectors 6, these cams being indicated overall by 8. As will be described in detail hereinafter, these cams act on butts 9 on the needles 4, on butts 10 on the jacks 5 and on a shoulder 11 on the selectors 6.

The selectors 6, which are of rocker type, comprise in known manner pattern butts 12 and a control butt 13 to follow the contour of substantially triangular cams 14 fixed to a fixed structure 15, when the selectors 6 are selected to activate the respective needles 4 in known manner. The selection takes place in correspondence with selection positions S1, S2, S3, S4, S5, S6 by selection devices which in the illustrated example are of the known rocker lever type 17, 18, selectively controlled, for example electromagnetically, in known manner by a control unit 19. The levers 17 which engage the pattern butts 12 push the relative selectors 6 to the base of the respective tricks 3, as shown in FIG. 1, so that the selectors 6 do not rise on the cams 14 and hence do not activate the respective needles 4. If the levers 17 are in a position such as not to engage the pattern butts 12, the relative selectors 6 rise on the cams 14 to activate the respective needles 4 in known manner. Logically the selector devices could be of the slider or other known type, as the type of device does not influence the present invention. Extraction cams 20 provided immediately upstream of the selection positions move the selectors 6 into the extracted position is known manner for selection.

According to one characteristic of the invention, the selectors 6 can slide in a portion **3*a* of the cylinder tricks 3 which lies at a radial distance from the axis (not shown) of the cylinder 2 greater than the distance of that portion 3*b* of the tricks 3 in which the needles 4 and jacks 5 slide. The selectors 6 also comprise a radially inwardly projecting appendix 21 to engage the base edge 22 of the respective jacks 5. The two portions 3*a* and 3*b* are preferably joined smoothly together by an arched base portion 3*c*. The fulcrum 23 of the selectors 6 is located substantially at the upper end of the selectors 6 on the radially outer edge of the respective jacks 5**.

The jacks preferably have a lower part wider than their upper part, the respective butt 10 being situated preferably at the region joining the two parts.

As can be seen from the drawings, the appendix 21 extends radially by a distance practically equal to the radial dimension of the base edge 22 of the jacks 5. The shoulder 11 on the selectors 6 defines a step on the radially outer side for engagement with lowering cams 24 formed in the cam skirt 8. The shoulder 11 lies at a greater height than that at which the appendix 21 of the selectors 6 lies. The appendix 21 is preferably of triangular shape, with an inclined side situated where the ends of the portions **3*a* and 3*b* of the tricks 3 are joined together by the arched portion 3*c***.

The configuration of the jacks 5 and selectors 6 advantageously enables the selectors 6 to exert correct thrust action on the jacks 5 and also enables the cams to exert correct control action, while maintaining a compact structure and satisfying the rocking requirements of the selectors 6.

Figure 2:
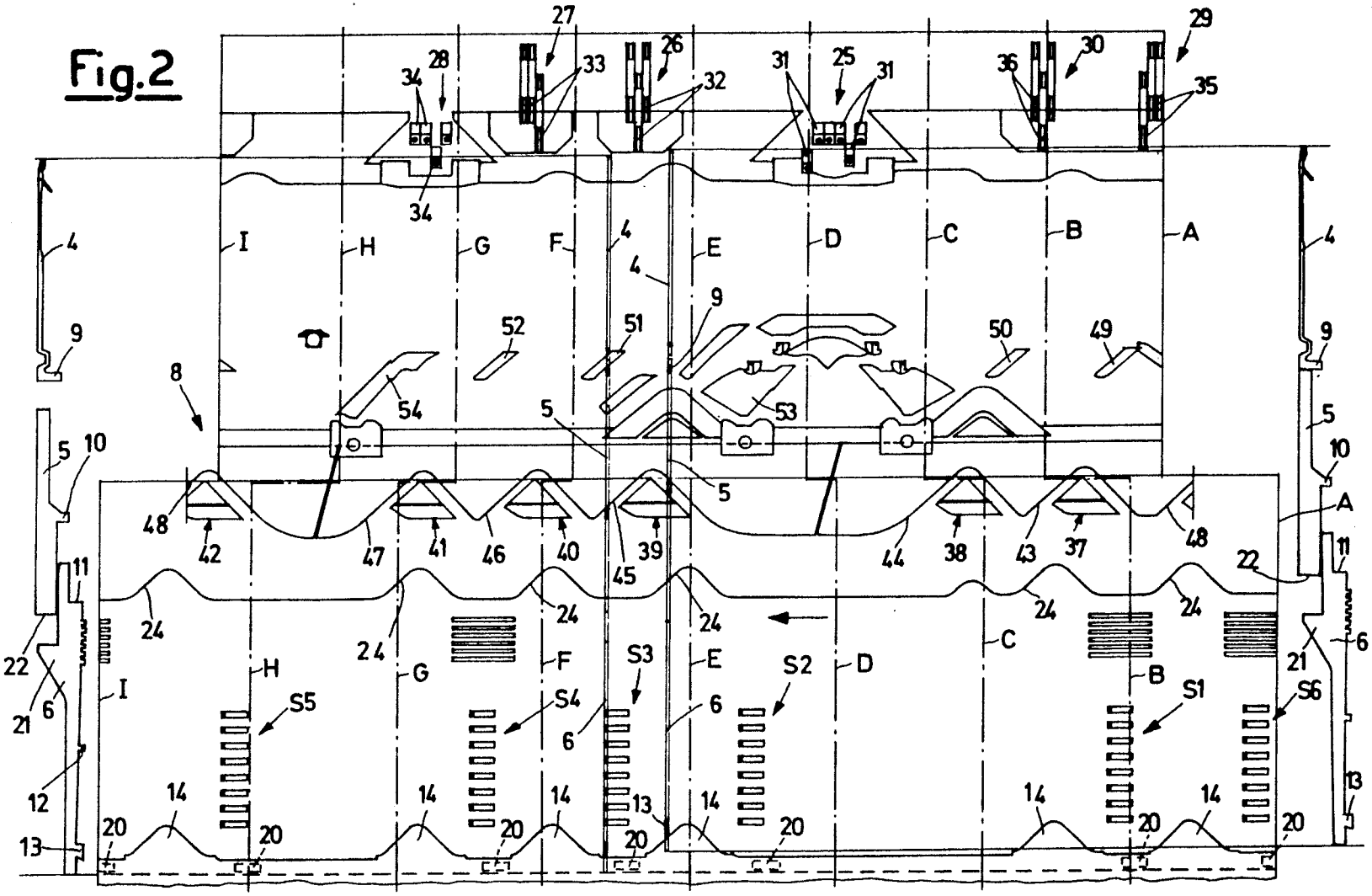
FIG. 2 is a plan development of the cam skirt of a machine according to the invention, also showing schematically the selection devices and yarn feed units and some significant positions of the stitch formation elements.

With specific reference to FIG. 2, the yarn feeds are indicated by 25, 26, 27, 28, 29 and 30 and are each provided with several yarn guides 31, 32, 33, 34, 35 and 36. The feeds 25 and 28 can for example provide background yarn and/or helanca type yarn, while the feeds 26, 27, 29 and 30 can for example provide yarns of various colours, including different colours for the same feed. The feed 28 could also provide yarns of different colours, so that the machine could work with five colours and the background and/or helanca yarn per course of knitting. The yarn guides are selectively operable between working and rest positions in known manner, as is apparent from FIG. 2, in which some yarn guides are shown working and others are shown at rest purely by way of example.

As the lower half of FIG. 2 represents the development of a circumference of radius and hence length greater than that of the upper part of the same figure, in the plan development those parts which in reality are aligned in the same vertical axial plane of the machine are in fact shown staggered in FIG. 2. For this reason, lines A, B, C, D, E, F, G, H, I are indicated which in reality respectively correspond in the machine itself. The raising cams for the jacks 5 are indicated by 37, 38, 39, 40, 41, 42 and can at least in part be formed by cams or cam elements (in particular the upper ones) which can be moved radially, i.e. can be excluded. As can be seen, the cams 37–42 have a height greater than the height of the raising cams 14 for the selectors 6. The lowering cams 24 for the selectors 6 have a contour corresponding to the lowering contour of the cams 14. The lowering cams 43, 44, 45, 46, 47, 48 for the jacks 5, acting on their butts 10, also have a height greater than the height of the lowering cams 24 for the selectors 6. In this manner, as can be seen for the central portion of FIG. 2 (selection position S2), but as also happens for the other selection positions S1, S3, S4, S5, S6, the selectors 6 selected to activate the respective needles 4 initially raise the respective jacks 5, which then proceed further under the action of the raising cams 37–42, to raise the respective needles 4 into their working position at the various feeds, whereas the selectors 6 follow a lower path, detached from the respective jacks 5, and are lowered by the lowering cams 24 which act on the shoulders 11 of the selectors 6 before the jacks 5 have completed their rise, i.e. independently of the respective jacks 5, so as to be again in the selection position when the respective jacks are descending or are about to reach the lowest point in their descent under the effect of the lowering cams 43–48, as shown in the centre of FIG. 2.

The lower and circumferentially shorter configuration of the cams 14 and 24 compared with the cams 37–42 and 43–48 therefore makes the selectors 6 independent of the jacks 5 over most of their movement, and enables the selection positions S1–S6 or most of them to be arranged very close together, so increasing the number of possible selections for the same upper diameter of the cylinder 2 or circle diameter of the needles 4, and hence increasing the selection and pattern possibilities.

In FIG. 2 the lowering cams for the needles 4 are indicated by 49, 50, 51 and 52 and operate on the butts 9 associated with the yarn feeds 29, 30, 26, 27. The lowering cams of the feeds 25 and 28 are indicated by 53 and 54. Advantageously at least some of the cams 49–52 can be moved radially and hence excluded. FIG. 2 shows further machine cams, which do not however concern the present invention and are conventional, and hence will not be further considered.

As can be seen by comparing FIGS. 1 and 2, the control cams for the needles 4, jacks 5 and selectors 6 are arranged on different circumferences, the control cams for the selectors 6 being on circumferences of greater radii for the reasons and with the effect already stated. The raising cams 14 for the selectors 6 are arranged on a circumference of greater diameter than the diameter of the circumference on which the selector lowering cams 24 are arranged.

If should be noted that all the cams operating on the needles 4, on the jacks 5 and on the selectors 6 have raising and/or lowering ramps with an angle of 45° or an angle never greater than 45°. In this manner, even with a large number of selection and yarn feed positions (for equal needle circle diameter and fineness), the machine can operate under conditions of high speed and reliability.

It is important to note that in their upward movement the needles 4 rise at an angle greater than 45°, given that their raising takes place within a circumferential space less than that within which the jacks 5 and selectors 6 rise, these being controlled by 45° raising cams which are however arranged on a circumference of greater radius. This greater needle inclination, which can exceed 50°, would not be possible with traditional systems operating with cams. In contrast, in the present invention the needles 4 are raised by the jacks 5 (which follow 45° cams) and there is therefore no possibility of needle damage or jamming. It will be understood that this is a characteristic aspect of the present invention, which hence allows a greater number of selection positions, in that the smaller circumferential raising space for the needles enables the needles to be raised a greater number of times for the same cylinder circumference. The needles 4 are lowered by cams of 45° inclination and hence without problems. On observing FIG. 2 it is apparent to an expert of the art that the control cams for the jacks 5 are such, or are controllable in such a manner, as to move the needles 4 either into their maximum position (with clearance of the previously formed loops) or into the tuck stitch position.

In a machine according to the present invention it is hence possible to increase the number of selection positions while maintaining the correct cylinder diameter and fineness for the required type of knitted article.

It should be noted that the needles 4 are normal needles and that the jacks 5 and selectors 6, even though of a specific shape, can be formed by conventional procedures and hence at a cost substantially of the same order as normal.

A machine according to the invention can be either of the single face type (needles only in the cylinder) or of the double face type (needles in the cylinder and in the dial).

Although a preferred embodiment of the invention has been specifically illustrated and described herein, it is to be understood that minor variations may be made in the apparatus without departing from the spirit and scope of the invention, as defined the appended claims.

We claim:

1. A circular knitting machine comprising a plurality of yarn feeds, a needle cylinder having an axis, longitudinal tricks in said needle cylinder, needles in said tricks, jacks in said tricks below said needles, selectors in said tricks below said jacks, said needles, jacks and selectors having butts thereon, and further comprising cams for raising and for lowering said needles, cams for raising and for lowering said jacks, cams for raising and for lowering said selectors, said cams respectively engaging said butts of said needles, jacks and selectors, means for rotating said needle cylinder relative to said cams about said axis, a plurality of selection positions associated with said plurality of yarn feeds, said selectors being rockable about a fulcrum and being selectable at said selection position for selectively activating and inactivating said needles, wherein said selectors comprise respective shanks and said tricks comprise a portion wherein said shanks of said selectors are slideable and which is situated at a greater distance from said axis than another portion of said tricks wherein said jacks are slideable, and wherein said selectors further comprise an appendix for engaging said jacks, said appendix extending radially inwardly from said shank toward the needle cylinder axis, and said fulcrum of said selectors being located at a radially outer edge of said jacks, said cams for raising said selectors having a lower amplitude than said cams for raising said jacks, and said selectors being lowered by said selector lowering cams independently of said jacks such that said selectors reattain a selection position when the respective jacks substantially reach a lowest point defined by said jack lowering cams.

2. A machine as claimed in claim 1, wherein said jacks have a base edge having a radial extent, and wherein said appendix of said selectors extends radially through a distance substantially equal to said radial extent of said base edge of said jacks.

3. A machine as claimed in claim 1, wherein each of said selectors comprises a shoulder defining a step at a radially outer side of said selectors for engaging said selector lowering cams.

4. A machine as claimed in claim 1, wherein said fulcrum is positioned proximate to an upper end of said selectors.

5. A machine as claimed in claim 1, wherein each of said selectors comprises a shoulder defining a step at a radially outer side of said selectors for engaging said selector lowering cams, and wherein said shoulder is located at a level higher than said appendix of said selectors.

6. A machine as claimed in claim 1 or 2, wherein said appendix is of substantially triangular configuration.

7. A machine as claimed in claim 1, wherein said portions of said tricks have bottom surfaces that are radius-joined together.

8. A machine as claimed in claim 1, wherein said jacks have a lower part that is wider than an upper part of said jacks in a direction radial to said needle cylinder.

9. A machine as claimed in claim 1, wherein said cams for raising and lowering said needles, said cams for raising and lowering said jacks, and said cams for raising and lowering said selectors are arranged on circumferences having different radii, said cams for raising and lowering said selectors being arranged on circumferences of greater radii.

10. A machine as claimed in claim 1, wherein said cams for raising said selectors are arranged on a circumference having a radius greater than a circumference on which said cams for lowering said selectors are arranged.

11. A machine as claimed in claim 1, wherein said selection positions comprise selection devices having rocking selection levers for selectively engaging said butts of said selectors.

12. A machine as claimed in claim 1, wherein at least some of said cams for raising said jacks comprise radially movable cams.

13. A machine as claimed in claim 1, wherein at least some of said cams for raising and lowering said needles comprise radially movable cams.

14. A machine as claimed in claim 1, wherein said cams for raising and lowering said jacks and said cams for raising and lowering said selectors have raising and lowering ramps arranged at an angle of about 45° relative to a horizontal plane.

15. A machine as claimed in claim 1, wherein said cams for raising said jacks comprise cams for moving said needles into a position for clearing previously formed stitch loops.

16. A machine as claimed in claim 1, wherein said cams for raising said jacks comprise cams for moving said needles into a tuck stitch position.

17. A machine as claimed in claim 1, wherein said plurality of yarn feeds comprises feeds providing yarns of different colors and yarns of different type.

18. A machine as claimed in claim 2, wherein said appendix is of substantially triangular configuration.

* * * * *